US011708230B2

(12) United States Patent
Mori et al.

(10) Patent No.: US 11,708,230 B2
(45) Date of Patent: Jul. 25, 2023

(54) MANUAL SHEET FEEDING DEVICE AND IMAGE FORMING APPARATUS

(71) Applicant: FUJIFILM Business Innovation Corp., Tokyo (JP)

(72) Inventors: Takuya Mori, Yokohama (JP); Yuya Chonabayashi, Yokohama (JP); Tomoya Kosuge, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 62 days.

(21) Appl. No.: 17/369,362

(22) Filed: Jul. 7, 2021

(65) Prior Publication Data

US 2022/0306413 A1 Sep. 29, 2022

(30) Foreign Application Priority Data

Mar. 29, 2021 (JP) ..... 2021-055140

(51) Int. Cl.
*B65H 3/06* (2006.01)
*B65H 3/44* (2006.01)

(52) U.S. Cl.
CPC ..... *B65H 3/06* (2013.01); *B65H 3/44* (2013.01); *B65H 2405/12* (2013.01); *B65H 2407/21* (2013.01); *B65H 2407/50* (2013.01)

(58) Field of Classification Search
CPC ..... B65H 3/06; B65H 3/0638; B65H 3/0661; B65H 3/5261; B65H 2405/115; B65H 2405/12; B65H 2405/121; B65H 2405/321; B65H 2405/324; B65H 2407/10; B65H 2407/21; B65H 2407/50
See application file for complete search history.

(56) References Cited

U.S. PATENT DOCUMENTS 5,901,951 A 5/1999 Yamaguchi
2008/0093789 A1* 4/2008 Lee ..... B65H 1/04 271/145
2009/0115123 A1* 5/2009 Toba ..... G03G 15/6511 271/171
2010/0244373 A1* 9/2010 Sunohara ..... B65H 3/44 271/264
2013/0049291 A1* 2/2013 Ohtsuki ..... B65H 1/08 271/162

(Continued)

FOREIGN PATENT DOCUMENTS

JP H10-35926 A 2/1998
JP 2004-131240 A 4/2004

(Continued)

OTHER PUBLICATIONS

Jan. 4, 2022 Extended European Search Report issued in European Patent Application No. 21191062.5.

*Primary Examiner* — Prasad V Gokhale
(74) *Attorney, Agent, or Firm* — Oliff PLC

(57) ABSTRACT

A manual sheet feeding device includes: a sheet feeding rotary body configured to separate and feed recording media placed on a manual sheet feeding unit one by one; a shielding unit configured to cover an outer side surface of the sheet feeding rotary body, the shielding unit having an aperture for exposing at least a part of the sheet feeding rotary body to an outside; and an opening and closing unit configured to open and close the aperture of the shielding unit.

17 Claims, 9 Drawing Sheets

(56) References Cited

U.S. PATENT DOCUMENTS

| | | | | |
|---|---|---|---|---|
| 2016/0332832 | A1* | 11/2016 | Okura | G03G 21/1633 |
| 2017/0017185 | A1* | 1/2017 | Woo | G03G 15/6511 |
| 2020/0010291 | A1* | 1/2020 | Shibayama | B65H 1/04 |
| 2020/0409302 | A1 | 12/2020 | Iwase | |

FOREIGN PATENT DOCUMENTS

| | | | |
|---|---|---|---|
| JP | 4478639 | B2 | 6/2010 |
| JP | 2016-150845 | A | 8/2016 |
| JP | 2017-214216 | A | 12/2017 |

* cited by examiner

MANUAL SHEET FEEDING DEVICE AND IMAGE FORMING APPARATUS

CROSS-REFERENCE TO RELATED APPLICATIONS

This application is based on and claims priority under 35 USC 119 from Japanese Patent Application No. 2021-055140 filed on Mar. 29, 2021.

BACKGROUND

Technical Field

The present disclosure relates to a manual sheet feeding device and an image forming apparatus.

Related Art

In a related art, for example, techniques disclosed in Patent Literatures 1 or 2 and the like have already been proposed as techniques related to a manual sheet feeding device.

Patent Literature 1 discloses a cleaning tool for a sheet feeding and transporting device including a sheet feeding roller that transports print media and a retard roller that separates the print media by being driven by the sheet feeding roller, the cleaning tool including: a cleaning holder detachably fitted so as to cover the sheet feeding roller; and a cleaning member attached to an outer peripheral surface of the cleaning holder.

Patent Literature 2 discloses that, as a cleaner that cleans a first roller, a first cleaner provided on a holding member supported by an apparatus body and a second cleaner provided on the guide member are provided, that the holding member is formed with plural divided apertures through which an object to be cleaned removed by the first cleaner on an upstream side in the rotation direction of the first roller at a cleaning position of the first cleaner passes, and that one of the apertures that overlaps with, on an extension line in a transport direction, a friction separating member of a sheet separating mechanism that has a width smaller than a full width of a sheet to be transported and is provided in a sheet feeding unit is wider than the friction separating member.

Patent Literature 1: JP-A-2016-150845

Patent Literature 2: Japanese Patent No. 4478639

SUMMARY

Aspects of non-limiting embodiments of the present disclosure relate to cleaning of a sheet feeding rotary body of a manual sheet feeding unit from an outside without using a configuration in which the manual sheet feeding unit is pulled out from an apparatus body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a manual sheet feeding device including:

a sheet feeding rotary body configured to separate and feed recording media placed on a manual sheet feeding unit one by one;

a shielding unit configured to cover an outer side surface of the sheet feeding rotary body, the shielding unit having an aperture for exposing at least a part of the sheet feeding rotary body to an outside; and an opening and closing unit configured to open and close the aperture of the shielding unit.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment of the present disclosure will be described with reference to the drawings.

First Exemplary Embodiment

Figure 1:
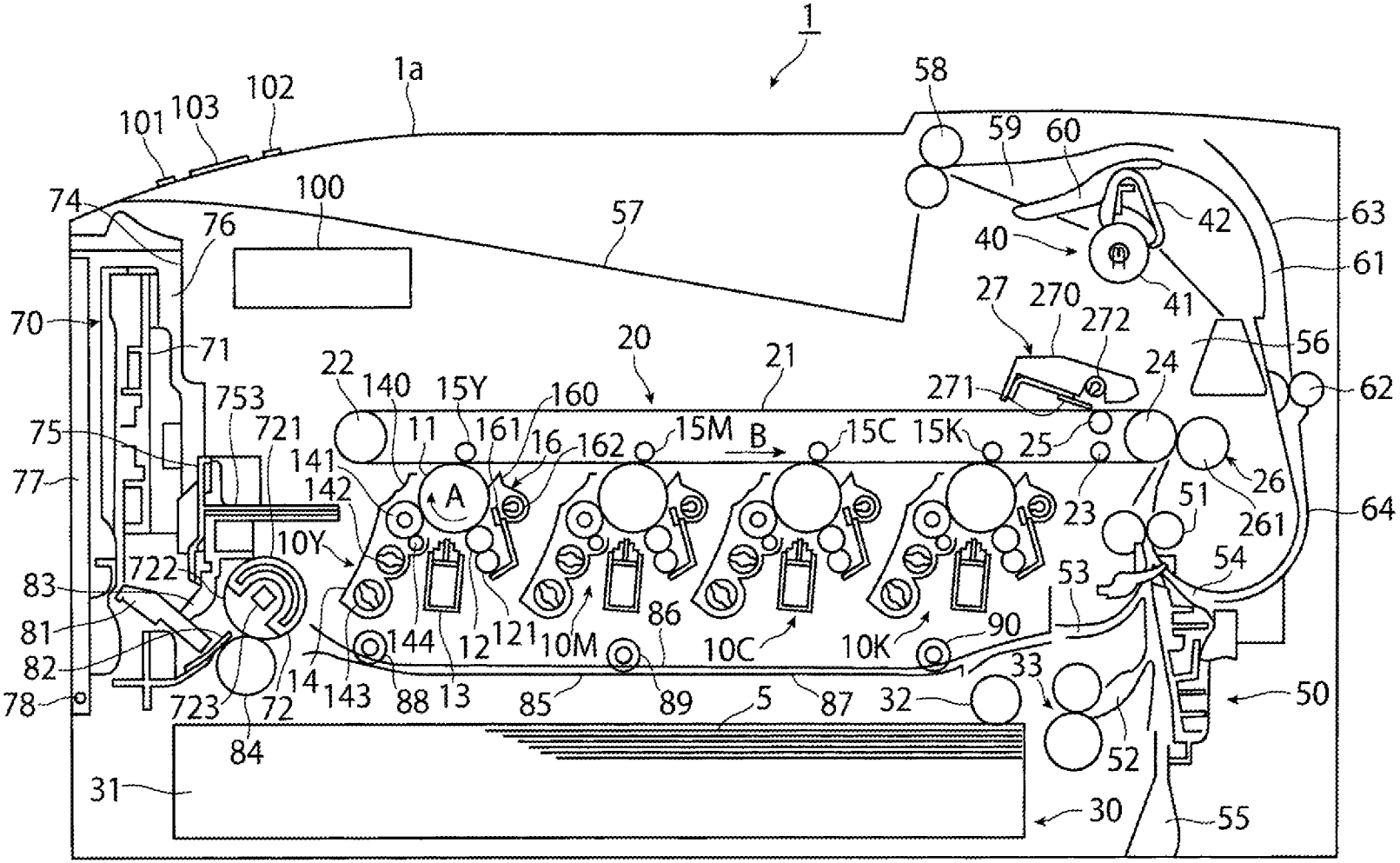
FIG. 1 is a schematic configuration view showing an image forming apparatus to which a manual sheet feeding device according to a first exemplary embodiment of the present disclosure is applied.

FIG. 1 is a configuration view showing an overall outline of an image forming apparatus to which a manual sheet feeding device according to a first exemplary embodiment of the present disclosure is applied.

<Overall Configuration of Image Forming Apparatus>

An image forming apparatus 1 according to the first exemplary embodiment is, for example, a color printer. The image forming apparatus 1 is capable of forming a full-color image, has achieved a reduction in size as compared with a related-art model, and is compatible with an A4 size recording medium. The image forming apparatus 1 includes plural image forming devices 10 configured to form a toner image to be developed with a toner which is a developer, an intermediate transfer device 20 configured to hold the toner image formed by each image forming device 10 and to finally transport the toner image to a secondary transfer position where the toner image is secondarily transferred to a recording sheet 5 which is an example of a recording medium, a sheet feeding device 30 configured to accommodate and feed the required recording sheet 5 to be supplied to the secondary transfer position of the intermediate transfer device 20, a fixing device 40 configured to fix the toner image on the recording sheet 5 secondarily transferred by the intermediate transfer device 20, and the like. A reference numeral 1*a* in the drawing denotes an apparatus body of the image forming apparatus 1, and the apparatus body 1*a* includes a support structure member, an exterior cover, and the like. In this exemplary embodiment, the plural image forming devices 10 and the intermediate transfer device 20 constitute an image forming unit.

As described above, the image forming apparatus 1 has achieved a reduction in size as compared with the related-art model. A height, a depth, and a width of the apparatus body 1*a* of the image forming apparatus 1 are smaller than those of a full-color model compatible with the A4 size recording paper 5 in the related art, and the size of the apparatus body 1*a* is substantially the same as that of a monochrome machine in the related art.

The image forming apparatus 1 includes the plural image forming devices 10, the intermediate transfer device 20, and the sheet feeding device 30. In order to reduce the size of the apparatus body 1*a* of the image forming apparatus 1, it is necessary to reduce a height, a depth, and a width of each of the plural image forming devices 10, the intermediate transfer device 20, and the sheet feeding device 30.

The image forming devices 10 include four image forming devices 10Y, 10M, 10C, 10K that exclusively form toner images of four colors which are yellow (Y), magenta (M), cyan (C), and black (K), respectively. The four image forming devices 10 (Y, M, C, K) are arranged in a line along a horizontal direction in an internal space of the apparatus body 1*a*.

As shown in FIG. 1, each of the image forming devices 10 (Y, M, C, K) includes a rotating photoconductor drum 11 as an example of an image carrier. Devices serving as an example of a toner image forming unit as described below are provided around the photoconductor drum 11. The devices include a charging device 12 configured to charge a peripheral surface (an image carrying surface) on which an image of the photoconductor drum 11 may be formed to a required potential, an exposure device 13 configured to irradiate a charged peripheral surface of the photoreceptor drum 11 with light based on image information (a signal) to form an electrostatic latent image (for each color) having a potential difference, a developing device 14 (Y, M, C, K) configured to develop the electrostatic latent image with a toner which is a developer of a corresponding color (Y, M, C, K) to form a toner image, a primary transfer device 15 (Y, M, C, K) configured to transfer the toner image to the intermediate transfer device 20, and a drum cleaning device 16 (Y, M, C, K) configured to remove and clean adhering matter such as the toner remaining and adhering on the image carrying surface of the photoreceptor drum 11 after the primary transfer.

The photoconductor drum 11 is formed by forming an image carrying surface having a photoconductive layer (a photosensitive layer) formed of a photosensitive material on a peripheral surface of a cylindrical or columnar base member to be grounded. The photoconductor drum 11 is supported so as to be rotated in a direction indicated by an arrow A by transmitting power from a driving device (not shown).

The charging device 12 includes a contact-type charging roller provided in contact with the photoconductor drum 11. The charging device 12 includes a cleaning roller 121 configured to clean a surface of the charging device 12. A charging voltage is supplied to the charging device 12. When the developing device 14 performs reversal development, a voltage or a current having the same polarity as charging polarity of the toner supplied from the developing device 14 is supplied as the charging voltage. As the charging device 12, a non-contact type charging device such as a scorotron provided in a non-contact state with a surface of the photoconductor drum 11 may be used.

The exposure device 13 includes an LED print head configured to form an electrostatic latent image by irradiating the photoconductor drum 11 with light according to image information by a light emitting diode (LED) serving as plural light emitting elements arranged along an axial direction of the photosensitive drum 11.

As shown in FIG. 1, each of the developing devices 14 (Y, M, C, K) includes, in a housing 140 in which an aperture and a developer accommodation chamber are formed, a developing roller 141 configured to carry a developer and to transport the developer to a developing region facing the photoconductor drum 11, agitation transport members 142, 143 such as two screw augers configured to transport the developer such that the developer passes through the developing roller 141 while agitating the developer, and a layer thickness regulating member 144 configured to regulate an amount (a layer thickness) of the developer carried by the developing roller 141. A developing voltage is supplied to the developing device 14 from a power supply device (not shown) between the developing roller 141 and the photoconductor drum 11. Power is transmitted from a driving device (not shown), so that the developing roller 141 and the agitation transport members 142, 143 rotate in a required direction. As the above-described four color developers 4 (Y, M, C, K), a two-component developer containing a non-magnetic toner and a magnetic carrier is used. The developing device 14 is supplied with a developer containing at least a corresponding color of toner from a toner cartridge (not shown) provided at one end portion of the agitation transport member 143 in the axial direction.

The primary transfer device 15 (Y, M, C, K) is a contact type transfer device including a primary transfer roller that contacts and rotates around the photoconductor drum 11 via the intermediate transfer belt 21 and is supplied with a primary transfer voltage. As the primary transfer voltage, a DC voltage having a polarity opposite to the charge polarity of the toner is supplied from a power supply device (not shown).

As shown in FIG. 1, the drum cleaning device 16 includes a container-shaped body 160 that partially opens, a cleaning plate 161 that comes into contact with a peripheral surface of the photoconductor drum 11 after the primary transfer at a required pressure to remove adhering matter such as a residual toner and to clean the photoconductor drum 11, and a delivery member 162 such as a screw auger configured to collect the adhering matter such as a toner removed by the cleaning plate 161 and to transport the adhering matter to a recovery system (not shown). As the cleaning plate 161, a plate-shaped member (for example, a blade) formed of a material such as rubber is used. The adhering matter such as the toner transported by the delivery member 162 of the cleaning device 16 is collected in a first toner collection bottle (not shown) provided at one end portion of the delivery member 162 in the axial direction. The first toner recovery bottle is provided at an end portion in the same direction as the toner cartridge described above.

As shown in FIG. 1, the intermediate transfer device 20 is provided at a position above each of the image forming devices 10 (Y, M, C, K). The intermediate transfer device 20 includes an intermediate transfer belt 21 that rotates in a direction indicated by an arrow B while passing through a primary transfer position between the photoconductor drum 11 and the primary transfer device 15 (the primary transfer roller), plural belt support rollers 22 to 25 configured to hold the intermediate transfer belt 21 in a desired state from an inner surface of the intermediate transfer belt 21 and to rotatably support the intermediate transfer belt 21, a secondary transfer device 26 serving as an example of a secondary transfer unit that is provided on an outer peripheral surface (an image carrying surface) side of the intermediate transfer belt 21 supported by the belt support roller 24 and is configured to secondarily transfer a toner image on the intermediate transfer belt 21 to the recording sheet 5, and a belt cleaning device 27 configured to remove adhering matter such as a toner and paper dust remaining and adhering on the outer peripheral surface of the intermediate transfer belt 21 after the intermediate transfer belt 21 has passed through the secondary transfer device 26 and to clean the intermediate transfer belt 21. The intermediate transfer belt 21 is stretched by the belt support roller 22 and the belt support roller 24 that have a relatively large outer diameter so as to form movement paths substantially parallel to each other.

As the intermediate transfer belt 21, for example, an endless belt formed of a material in which a resistance adjusting agent such as carbon black is dispersed in a synthetic resin such as a polyimide resin or a polyamide resin is used. The belt support roller 22 is a tension applying roller configured to apply tension to the intermediate transfer belt 21, the belt support roller 23 is a surface roller configured to form an image forming surface of the intermediate transfer belt 21, the belt support roller 24 is a driving roller that is rotationally driven by a driving device (not shown) also serving as a back support roller for the secondary transfer, and the belt support roller 25 is a facing roller that faces a cleaning plate 271 of the belt cleaning device 27.

As shown in FIG. 1, the secondary transfer device 26 is a contact type transfer device including a secondary transfer roller 261 that contacts and rotates on the peripheral surface of the intermediate transfer belt 21 and is supplied with a secondary transfer voltage at a secondary transfer position that is an outer peripheral surface part of the intermediate transfer belt 21 supported by the belt support roller 24 in the intermediate transfer device 20. A DC voltage having the opposite polarity or the same polarity as the charge polarity of the toner is supplied as the secondary transfer voltage from the power supply device (not shown) to the secondary transfer roller 261 or the belt support roller 24 of the intermediate transfer device 20.

The belt cleaning device 27 includes a container-shaped body 270 that partially opens, a cleaning plate 271 serving as an example of a contact member that comes into contact with a peripheral surface of the intermediate transfer belt 21 after the secondary transfer at a required pressure to remove adhering matter such as a residual toner and to clean the intermediate transfer belt 21, and a delivery member 272 such as a screw auger configured to collect the adhering matter such as a toner removed by the cleaning plate 271 and to transport the adhering matter to a recovery system (not shown). As the cleaning plate 271, a plate-shaped member (for example, a blade) formed of a material such as rubber is used. The adhering matter such as the toner transported by the delivery member 272 of the belt cleaning device 27 is collected in a second toner collection bottle (not shown) provided at one end portion of the delivery member 272 in the axial direction. The second toner recovery bottle is provided at an end portion in the same direction as the toner cartridge and the first toner recovery bottle described above.

The fixing device 40 includes, inside a housing (not shown) in which an introduction port and a discharge port of the recording sheet 5 are formed, a heating rotary body 41 of a roller form or a belt form that rotates in a direction indicated by an arrow and is heated by a heating unit such that a surface temperature of the heating rotary body 41 is maintained at a predetermined temperature, a pressurizing rotary body 42 of a belt form or a roller form that comes into contact with the heating rotary body 41 at a predetermined pressure and that is driven to rotate in a state substantially along the axial direction of the heating rotary body 41, and the like. In the fixing device 40, a contact portion at which the heating rotary body 41 and the pressurizing rotary body 42 are in contact is a fixing processing unit configured to perform required fixing processing (heating and pressurizing).

The sheet feeding device 30 is provided at a position below the image forming devices 10 (Y, M, C, K) along a vertical direction. The sheet feeding device 30 includes a single (or plural) sheet accommodating body 31 configured to accommodate the recording sheets 5 of a desired size, type, and the like in a stacked state, and a delivery device 32 configured to separate and deliver the recording sheets 5 one by one from the sheet accommodating body 31. The sheet accommodating body 31 is attached, for example, such that the sheet accommodating body 31 may be pulled out from a front surface of the apparatus body 1*a*, that is, a side surface (in this exemplary embodiment, a left surface in FIG. 1) facing the user during operation.

Examples of the recording sheet 5 include plain paper used in an electrophotographic copier, a printer, and the like, thin paper such as tracing paper, and a transparency for an overhead projector (OHP). In order to further improve smoothness of the image surface after fixing, a surface of the recording sheet 5 may be smooth. For example, coated paper in which a surface of the plain paper is coated with a resin or the like, and so-called thick paper having a relatively large basis weight such as art paper for printing may be used.

A transport device 50 configured to transport the recording sheet 5 delivered from the sheet feeding device 30 to the secondary transfer position is provided between the sheet feeding device 30 and the secondary transfer device 26. As will be described later, in addition to the recording sheet 5 delivered from the sheet feeding device 30, the transport device 50 transports, to the secondary transfer position, the recording sheet 5 fed from a manual sheet feeding device 70 serving as an example of a manual sheet feeding unit, the recording sheet 5 transported through a duplex transport path 61 in a state in which an image is formed on one side and front and back sides are reversed, or the recording sheet 5 delivered from an auxiliary sheet feeding device (not shown) provided as an optional device at a lower portion of the apparatus body 1*a* of the image forming apparatus 1.

The transport device 50 includes a single or plural sheet transport roller pairs 51 and plural sheet feeding transport paths including plural transport guides. The plural sheet feeding transport paths includes a first sheet feeding transport path 52 configured to transport the recording sheet 5 delivered from the sheet feeding device 30 configured to deliver the recording sheet 5 according to the sheet feeding device 30 or the like as described above, a second sheet feeding transport path 53 configured to transport the recording sheet 5 delivered from the manual sheet feeding device 70, a third transport device 54 configured to transport the recording sheet 5 whose front and back sides are reversed via the duplex transport path 61, and a fourth transport device 55 configured to transport the recording sheet 5 delivered from the auxiliary sheet feeding device (not shown), as will be described later. The first to fourth sheet feeding transport paths 52 to 55 are provided such that a part thereof forms a common transport path.

The sheet transport roller pair 51 provided immediately before the secondary transfer position in the first to fourth sheet feeding transport paths 52 to 55 is, for example, a roller (a registration roller) configured to adjust a timing of transporting the recording sheet 5. A sheet transport path 56 is provided between the secondary transfer device 26 and the fixing device 40 to transport the recording sheet 5 after the secondary transfer, which is delivered from the secondary transfer device 26, to the fixing device 40. Further, a discharge transport path 59 including a sheet discharge roller pair 58 configured to discharge the recording sheet 5 after fixing delivered from the fixing device 40 to a sheet discharge unit 57 at an upper portion of the image forming apparatus body 1*a* is provided at a portion close to the discharge port of the recording sheet 5 formed in the apparatus body 1*a* of the image forming apparatus 1.

A switching gate 60 configured to switch the sheet transport path is provided between the fixing device 40 and the sheet discharge roller pair 58. A rotation direction of the sheet discharge roller pair 58 is switchable between a forward rotation direction (a discharge direction) and a reverse rotation direction. When images are formed on both sides of the recording sheet 5, after a rear end of the recording sheet 5 having an image formed on one side has passed through the switching gate 60, the rotation direction of the sheet discharge roller pair 58 is switched from the forward rotation direction (the discharge direction) to the reverse rotation direction. A transfer path of the recording sheet 5 transported in the reverse rotation direction by the sheet discharge roller pair 58 is switched by the switching gate 60, and the recording sheet 5 is transported to the duplex transport path 61 formed along a side surface of the apparatus body 1*a* of the image forming apparatus 1 along a substantially vertical direction. The duplex transport path 61 includes the sheet transport roller pair 62 and transport guides 63, 64 configured to transport the recording sheet 5 to the sheet transport roller pair 51 in a state in which the front and back surfaces are reversed.

In FIG. 1, a reference numeral 100 denotes a control device configured to execute overall control of an operation of the image forming apparatus 1. The control device 100 includes a central processing unit (CPU), a read only memory (ROM), and a random access memory (RAM) (not shown), or a bus configured to connect the CPU, the ROM, and the like, a communication interface, and the like.

Reference numerals 101, 102 denote operation buttons configured to operate the image forming apparatus 1, and 103 denotes a display panel configured to display an operation state of the image forming apparatus 1.

<Operation of Image Forming Apparatus>

Hereinafter, a basic image forming operation performed by the image forming apparatus 1 will be described.

Here, an operation in a full-color mode of forming a full-color image by combining toner images of four colors (Y, M, C, K) using the above-described four image forming devices 10 (Y, M, C, K) will be described.

When the image forming apparatus 1 receives command information of a request for a full-color image forming operation (printing) from a user interface, a printer driver, or the like (not shown), the four image forming devices 10 (Y, M, C, K), the intermediate transfer device 20, the secondary transfer device 26, the fixing device 40, and the like are started.

Further, in each of the image forming devices 10 (Y, M, C, K), as shown in FIG. 1, each photoconductor drum 11 first rotates in the direction indicated by the arrow A, and each charging device 12 charges the surface of each photoconductor drum 11 to a required polarity (a negative polarity in the first exemplary embodiment) and a required potential. Subsequently, the exposure device 13 irradiates the surface of the charged photoconductor drum 11 with light emitted based on an image signal obtained by converting information of an image input to the image forming apparatus 1 into each color component (Y, M, C, K), and forms an electrostatic latent image of each color component formed with a required potential difference on the surface of the photoreceptor drum 11.

Subsequently, each of the image forming devices 10 (Y, M, C, K) supplies a toner of a corresponding color (Y, M, C, K) charged to a required polarity (a negative polarity) from the developing roller 141 to the electrostatic latent image of each color component formed on the photoconductor drum 11, and electrostatically attaches the toner to the electrostatic latent image to execute development. By this development, the electrostatic latent images of the color components formed on the photoconductor drums 11 are developed as toner images of four colors (Y, M, C, K) developed with the toners of the corresponding colors.

Subsequently, when the toner images of the colors formed on the photoconductor drums 11 of the image forming devices 10 (Y, M, C, K) are transported to the primary transfer position, the primary transfer devices 15 (Y, M, C, K) execute the primary transfer in a state in which the toner images of the colors are sequentially superimposed on the intermediate transfer belt 21 rotating in the direction indicated by the arrow B of the intermediate transfer device 20.

Further, in each of the image forming devices 10 (Y, M, C, K) in which the primary transfer is completed, the drum cleaning device 16 scrapes off the adhering matter and cleans the surface of the photoconductor drum 11. Accordingly, the image forming devices 10 (Y, M, C, K) are in a state in which a next image forming operation may be performed.

Subsequently, in the intermediate transfer device 20, the toner image primarily transferred by the rotation of the intermediate transfer belt 21 is held and transported to the secondary transfer position. On the other hand, in the sheet feeding device 30, the required recording sheet 5 is delivered to the first sheet feeding transport path 52 in accordance with the image forming operation. In the first sheet feeding transport path 52, the sheet transport roller pair 51 serving as a registration roller delivers and supplies the recording sheet 5 to the secondary transfer position in accordance with the transfer timing.

At the secondary transfer position, the secondary transfer device 26 secondarily transfers the toner image on the intermediate transfer belt 21 onto the recording sheet 5 at a time. In the intermediate transfer device 20 in which the secondary transfer is completed, the belt cleaning device 27 removes the adhering matter such as the toner remaining on the surface of the intermediate transfer belt 21 after the secondary transfer and cleans the intermediate transfer belt 21.

Subsequently, the recording sheet 5 to which the toner image is secondarily transferred is separated from the intermediate transfer belt 21, and then is transported to the fixing device 40 via the sheet transport path 56. In the fixing device 40, the recording sheet 5 after the secondary transfer is introduced and passed through the contact portion between the rotating heating rotary body 41 and the rotating pressurizing rotary body 42, thereby fixing the unfixed toner image to the recording sheet 5 by performing necessary fixing processing (heating and pressurizing). Finally, in the image forming operation for only forming an image on one side of the recording sheet 5 after the fixing has been completed, the recording sheet 5 is discharged by the sheet discharge roller pair 58 to, for example, the sheet discharge unit 57 provided at the upper portion of the apparatus body 1*a*.

When an image is formed on both sides of the recording sheet 5 and when the recording sheet 5 on which an image is formed on one side of the recording sheet 5 is transported to the sheet discharge unit 57 by the sheet discharge roller pair 58, a rotation direction of the sheet discharge roller pair 58 is switched to the reverse direction while the sheet discharge roller pair 58 holds the rear end of the recording sheet 5. A transport direction of the recording sheet 5 transported in the reverse direction by the sheet discharge roller pair 58 is switched to a duplex transport path 61 side by the switching gate 60. Thereafter, the recording sheet 5 is transported to the sheet transport roller 51 in a state in which the front and back sides are reversed through the duplex transport path 61 including the transport roller pair 62. The sheet transport roller 51 delivers and supplies the recording sheet 5 to the secondary transfer position in accordance with the transfer timing. A toner image is secondarily transferred from the intermediate transfer belt 21 to a back surface (a second surface) of the recording sheet 5. The recording sheet 5 is subjected to the fixing processing performed by the fixing device 40, and is discharged by the sheet discharge roller pair 58 into the sheet discharge unit 57 provided at the upper portion of the apparatus body 1*a* with the second surface of the recording sheet 5 facing downward.

By the above operation, the recording sheet 5 on which a full-color image is formed by combining toner images of four colors is output. When a monochrome image is formed in the image forming apparatus 1, the monochrome image formed of a black (K) toner image is formed using only the black image forming device 10K.

<Configuration of Manual Sheet Feeding Device>

Figure 3:
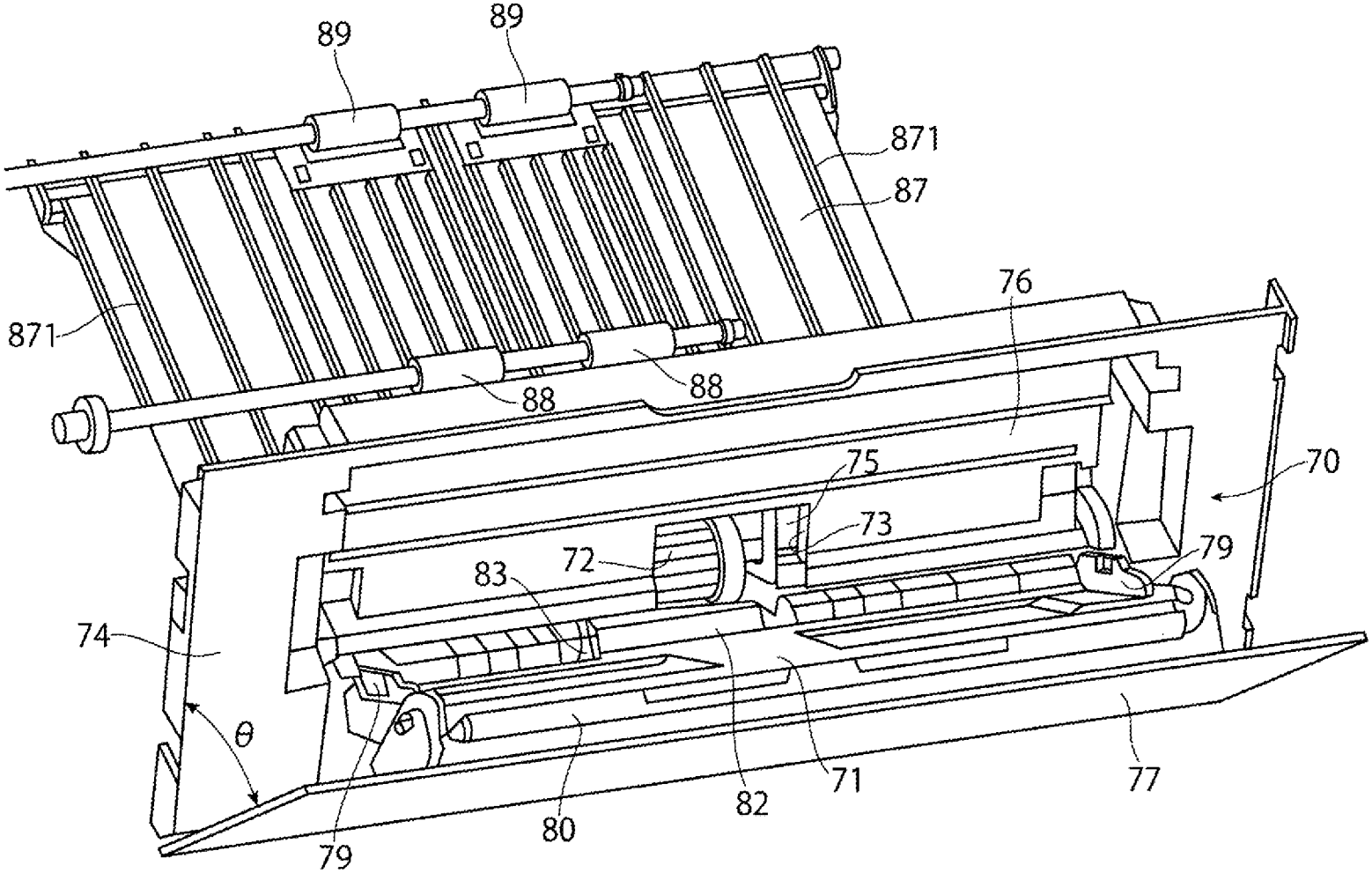
FIG. 3 is a perspective configuration view showing the manual sheet feeding device according to the first exemplary embodiment of the present disclosure.

FIG. 3 is a perspective configuration view showing the manual sheet feeding device of the image forming apparatus according to the first exemplary embodiment.

As shown in FIG. 1, the image forming apparatus 1 includes a manual sheet feeding device 70 configured to manually supply the recording sheet 5 desired by a user to a front surface of the apparatus body 1*a*, that is, a front surface (in this exemplary embodiment, a left side surface in FIG. 1) facing the user at a time of an operation. The manual sheet feeding device 70 is provided inside a front surface of the apparatus body 1*a*.

As shown in FIG. 3, the manual sheet feeding device 70 includes: a feed roller 72 serving as an example of a sheet feeding rotary body configured to separate and feed one by one the recording sheets 5 placed on a manual sheet feeding tray 71 serving as an example of a manual sheet feeding unit; an inner cover 74 serving as an example of a shielding member configured to cover an outer side surface of the feed roller 72, the shielding member having an aperture 73 exposing at least a part of the feed roller 72 to an outside; and an opening and closing cover 75 serving as an example of an opening and closing unit configured to open and close the aperture 73 of the inner cover 74.

Figure 2:
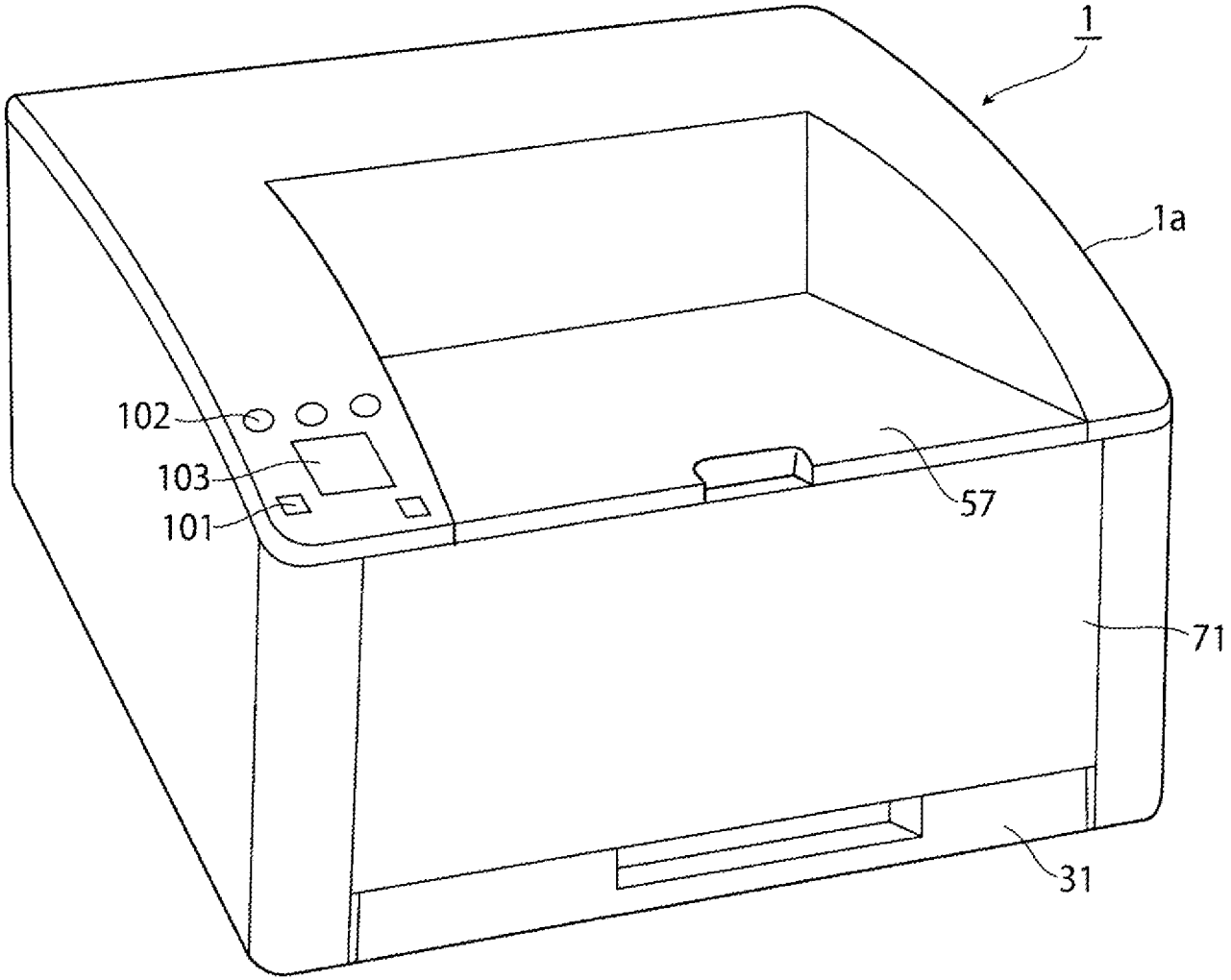
FIG. 2 is an external perspective view showing the image forming apparatus to which the manual sheet feeding device according to the first exemplary embodiment of the present disclosure is applied.

As shown in FIG. 1, a recess 76 for accommodating the manual sheet feeding tray 71 is formed on the front surface of the apparatus body 1*a* of the image forming apparatus 1 by the inner cover 74. As shown in FIGS. 1 to 3, the recess 76 of the apparatus body 1*a* is covered with a front cover 77. The front cover 77 is attached to the apparatus body 1*a* in a manner of being openable and closable by a required angle θ around a rotation fulcrum 78 (see FIG. 1) provided at a lower end portion of the front cover 77. The front cover 77 is formed in a substantially rectangular flat plate shape in front view. The opening and closing angle θ of the front cover 77 is set freely. However, in the first exemplary embodiment, the opening and closing angle θ is set to a required angle smaller than 90 degrees. By setting the opening and closing angle θ of the front cover 77 to an angle smaller than 90 degrees, when the user uses the manual sheet feeding device 70, an arrangement area of the image forming apparatus 1 is prevented from being unnecessarily enlarged as the front cover 77 is opened.

Figure 4:
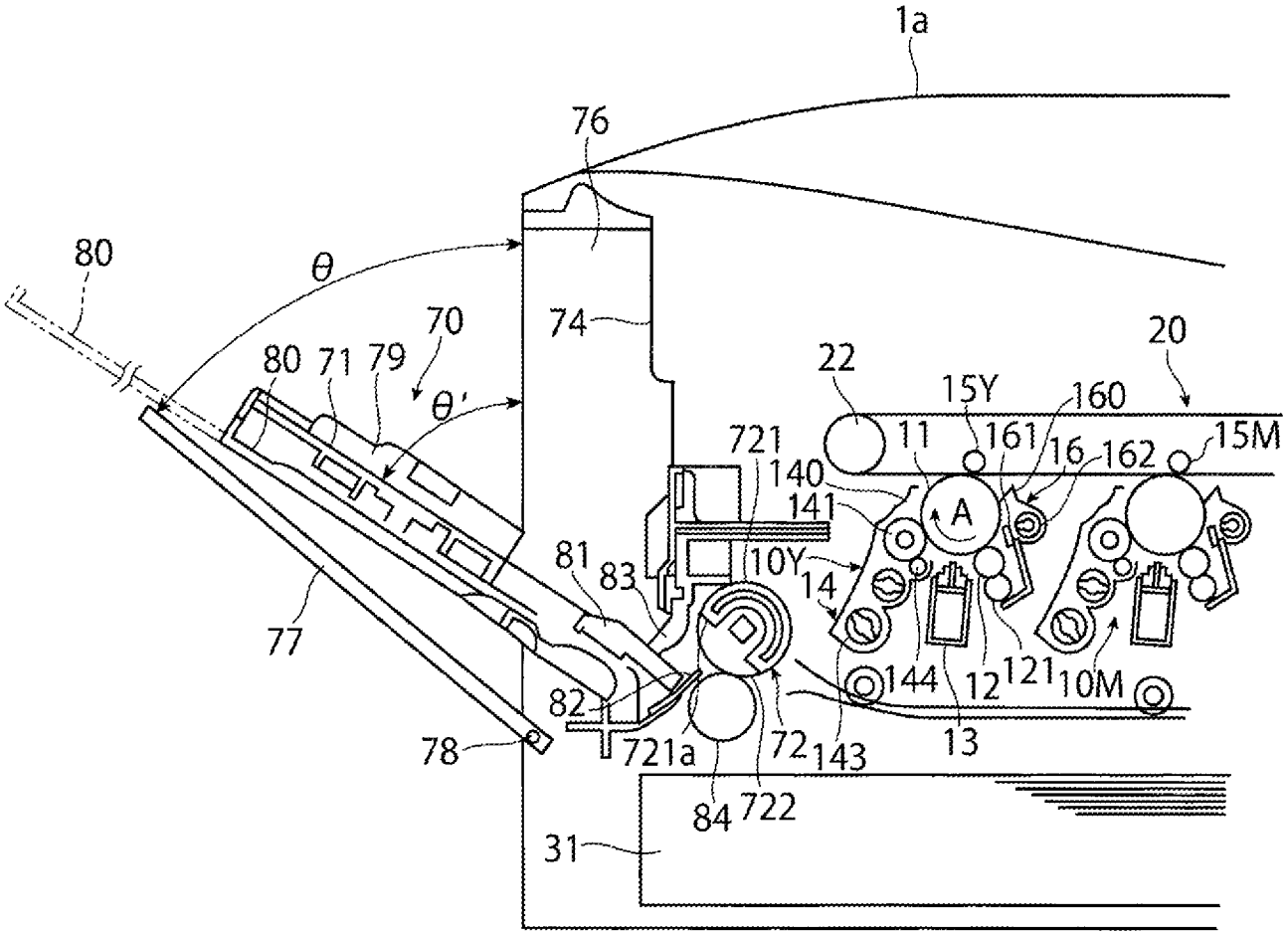
FIG. 4 is a schematic configuration view showing the image forming apparatus, to which the manual sheet feeding device according to the first exemplary embodiment of the present disclosure is applied, in a state in which a front cover is opened.

As shown in FIG. 3, the manual sheet feeding tray 71 is attached to an inner side surface of the front cover 77 so as to be inclined and moved in accordance with an opening and closing operation of the front cover 77. A lower end portion of the manual sheet feeding tray 71 is supported on the apparatus body lain a manner of being capable of moving obliquely. An upper end portion of the manual sheet feeding tray 71 is supported on the front cover 77 in a manner of being capable of moving obliquely. When the front cover 77 is opened, the lower end portion of the manual sheet feeding tray 71 rotates in an opening direction together with the front cover 77, and an upper end portion of the manual sheet feeding tray 71 is moved obliquely in the opening direction by an angle larger than an opening angle of the front cover 77. As a result, as shown in FIG. 4, when the front cover 77 is opened, the manual sheet feeding tray 71 is moved to a position where the manual sheet feeding tray 71 is inclined by an inclination angle θ' larger than the opening angle θ of the front cover 77.

On an upper surface of the manual sheet feeding device 71, a side guide 79 configured to guide both end portions in a width direction along the surface of the recording sheet 5 intersecting with a sheet feeding direction of the recording sheet 5 is provided in a manner of being movable in accordance with a size of the recording sheet 5. The recording sheet 5 is placed on the manual sheet feeding tray 71 with a center of the recording sheet 5 in the width direction intersecting with the sheet feeding direction as a reference (a so-called center register).

An extension tray 80 is built in the manual sheet feeding tray 71 such that the extension tray 80 may be pulled out. As indicated by a two-dot chain line in FIG. 4, the extension tray 80 may be used by the user pulling out the extension tray 80 obliquely upward with a hand of the user in a state in which the front cover 77 is opened.

The extension tray 80 is built in the manual sheet feeding tray 71 such that the extension tray 80 may be further extended along with the rotation of the manual sheet feeding tray 71.

The extension tray 80 may be used according to the size of the recording sheet 5 by rotating (inclining) the extension tray 80 with respect to the manual sheet feeding tray 71 after the user has pulled out the extension tray 80.

As shown in FIG. 4, a guide member 81 configured to guide the recording sheet 5 placed on the manual sheet feeding tray 71 to the feed roller 72 and an introduction member 82 that is formed of a metal sheet metal or the like provided in an inclined state at a front end portion of the guide member 81 and that is configured to introduce a front end of the recording sheet 5 to a nip portion of the feed roller 72 are provided at the lower end portion of the manual sheet feeding tray 71. An actuator 83 of a sheet sensor configured to detect the front end of the recording sheet 5 is rotatably provided on a side of the introduction member 82.

As shown in FIG. 1, the feed roller 72 that intermittently rotates by a predetermined angle at a predetermined timing is provided inside the apparatus body 1*a* of the image forming apparatus 1. A retard roller 84, which is an example of a separating rotary body, is provided in contact with the feed roller 72. The feed roller 72 includes a roller body 721 formed of an elastic body such as rubber formed in a substantially semi-cylindrical shape having a central angle larger than 180 degrees, two assist rollers 722 each integrally provided at a respective one of two end portions of the roller body 721 along the axial direction, and a rotation shaft 723 having a substantially rectangular cross section.

The retard roller 84 is formed as a cylindrical body formed of rubber or the like having a total length of the roller body 721 of the feed roller 72 and the two assist rollers 722. The retard roller 84 is configured to prevent the front end of the recording sheet 5 delivered by the feed roller 72 from coming into contact with the retard roller 84 and preventing the recording sheet 5 other than the uppermost recording sheet 5 from being delivered.

As shown in FIG. 1, the feed roller 72 is normally stopped in a state in which a front end portion 721*a* of the feed roller 72 along the rotation direction of the roller body 721 formed of an elastic body such as rubber formed in a substantially semi-cylindrical shape is located upstream of the nip portion with the retard roller 84 along the rotation direction by a required angle. Then, at a time of sheet feeding, the feed roller 72 rotates in a counterclockwise direction in the drawing, the roller body 721 comes into contact with the surface of the uppermost recording sheet 5 to start transporting the recording sheet 5, and the retard roller 84 rotates in the counterclockwise direction in the drawing to prevent the second and subsequent recording sheets 5 from being fed. The feed roller 72 performs one rotation or plural rotations and stops at a position shown in FIG. 1.

As shown in FIGS. 1 and 4, a manual sheet feeding transport path 85 configured to transport the recording sheet 5 separated one by one by the feed roller 72 and the retard roller 84 to the sheet transport roller pair 51 is provided downstream of the feed roller 72 in the sheet feeding direction and substantially along the horizontal direction. The manual sheet feeding transport path 85 includes guide members 86, 87 configured to guide a front surface and a back surface of the recording sheet 5, and plural transport roller pairs 88, 89, 90 configured to transport the recording sheet 5 along the manual sheet feeding transport path 85. As shown in FIG. 3, plural ribs 871 that come into contact with the back surface of the recording sheet 5 are provided on the guide member 87 along the transport direction.

As described above, the image forming apparatus 1 according to the first exemplary embodiment achieves a reduction in size as compared with the related-art model, and it is necessary to cause the guide members 86, 87 constituting the manual paper feeding transport path 85 to be thin in order to set a height of the apparatus body 1*a* to be small. Therefore, it is necessary to fix the guide members 86, 87 to the apparatus body 1*a* of the image forming apparatus 1 with low rigidity, and it is difficult to use a configuration in which the guide members 86, 87 are provided in a state of being fixed to the inner cover 70 and may be integrally pulled out from the apparatus body 1*a*, and in which the feed roller 72 is exposed to the outside and cleaned at a time of cleaning.

As shown in FIG. 1, in order to reduce the size of the image forming apparatus 1, an end portion of a movement path of the intermediate transfer belt 21 is located in a vicinity of an upper portion of the feed roller 72. Therefore, a cloud toner floating around the intermediate transfer belt 21, paper dust of the manually fed recording sheet 5, or the like adheres to the feed roller 72 along with the rotation of the intermediate transfer belt 21. When the cloud toner (an example of a powder), the paper dust of the recording paper 5, or the like adheres to the feed roller 72 and accumulates, the feed roller 72 may slip when the recording sheet 5 placed on the manual sheet feeding tray 71 is fed, and a transport failure of the recording sheet 5 may occur.

Therefore, in order to eliminate the transport failure of the recording sheet 5 due to the feed roller 72, at least the end portion 721*a* or the like of the roller body 721 of the feed roller 72 formed of rubber or the like along the rotation direction is cleaned by being wiped with water or the like.

In the related art, the feed roller 72 is covered with the inner cover 74 and is not exposed to the outside. Therefore, in order to clean the feed roller 72, the manual sheet feeding tray 71 may be pulled out from the apparatus body 1*a*, the manual sheet feeding tray 71 is pulled out from the apparatus body 1*a*, and the feed roller 72 is exposed to the outside and cleaned.

However, when the manual sheet feeding tray 71 may be pulled out from the apparatus body 1*a*, a guide mechanism such as a guide rail that enables the manual sheet feeding tray 71 to be attached to and detached from the apparatus body 1*a* is required. A height and a width of the manual sheet feeding tray 70 increase by that amount, and it becomes difficult to reduce the size of the apparatus.

In order to clean the feed roller 72, it is also conceivable to expose the feed roller 72 to the outside with the inner cover 74 being cut out.

However, in this case, the feed roller 72 is always exposed to the outside. Therefore, when the front cover 77 is opened, a sheet feeding mechanism of the manual sheet feeding device 70 is exposed to the outside, which causes a new technical problem that the appearance of the apparatus is deteriorated and consideration for safety is insufficient.

Therefore, as shown in FIG. 3, the manual sheet feeding device 70 according to the first exemplary embodiment includes the inner cover 74 that has the aperture 73 exposing at least a part of the feed roller 72 to the outside and is configured to cover the outer side surface of the feed roller 72, and the opening and closing cover 75 configured to open and close the aperture 73 of the inner cover 74. Here, exposing at least a part of the feed roller 72 to the outside means exposing at least the front end portion 721*a* of the feed roller 72 along the rotation direction of the roller body 721 to the outside.

That is, in the first exemplary embodiment, as shown in FIG. 3, at a position corresponding to the feed roller 72 of the inner cover 74, the aperture (a cutout portion) 73 having a substantially rectangular shape in front view is provided such that a region on the front surface side of the feed roller 72 is exposed to the outside. The aperture 73 extends to a lower end edge of the inner cover 74. The aperture 73 of the inner cover 74 has a height above an upper end portion of the feed roller 72. The aperture 73 of the inner cover 74 is set to be slightly longer than an entire length of the feed roller 72 along the axial direction. Therefore, when the front cover 77 is opened, the user may contact a substantially half region on the front surface side from the upper end portion of the feed roller 72 exposed to the outside via the aperture 73.

Figure 5:
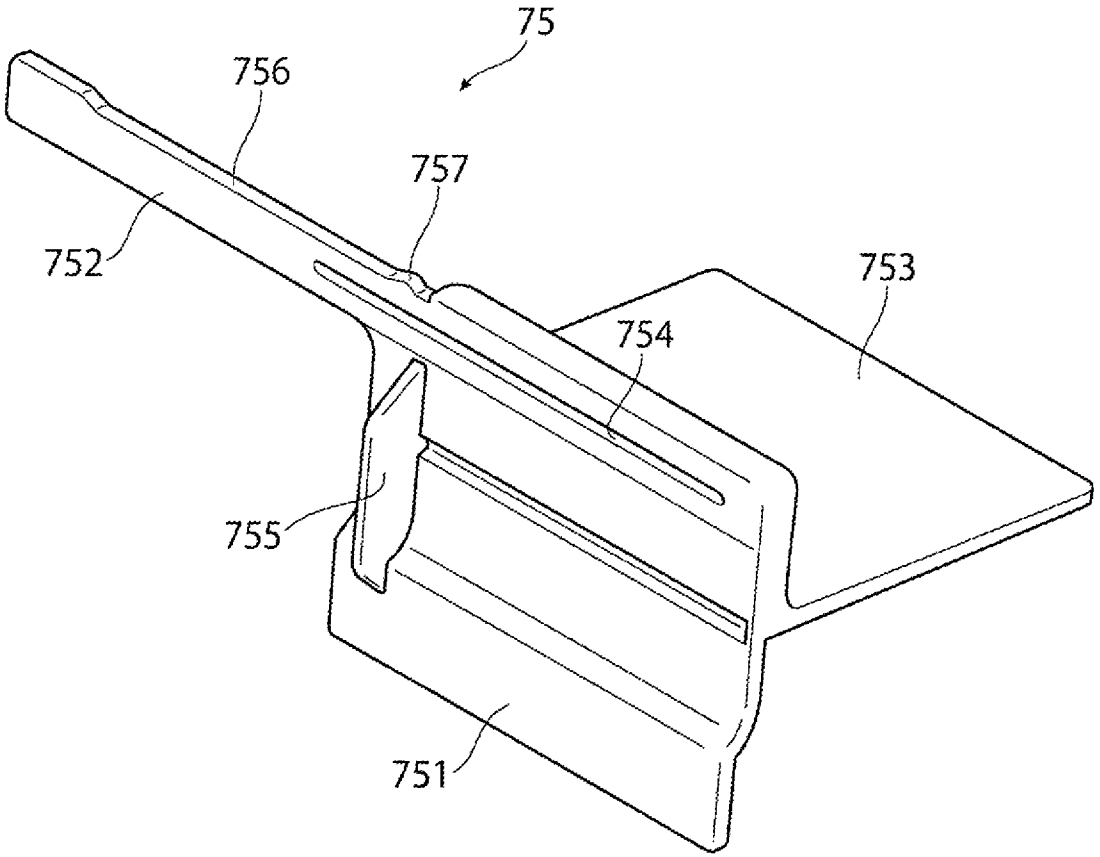
FIG. 5 is an external perspective view showing an opening and closing cover.

The opening and closing cover 75 configured to open and close the aperture 73 is provided at the aperture 73 of the inner cover 74 in a manner of being movable along the width direction of the recording sheet 5. As shown in FIG. 5, the opening and closing cover 75 includes a cover portion 751 formed in a substantially rectangular flat plate shape in front view, a guide rail portion 752 extending on one side (a left side in the drawing) of an upper end of the cover portion 751 in the horizontal direction, and an eaves portion 753 that has a substantially rectangular shape in plan view and extends along the horizontal direction toward a back surface side in a middle of a back surface of the cover portion 751. The cover portion 751 has a substantially rectangular flat plate shape in front view, but is not a perfect flat plate, and is formed in a shape in which a lower end portion of the cover portion 751 slightly protrudes to the front surface side via a bent portion in accordance with a shape of a lower end portion of the inner cover 74.

Figure 6:
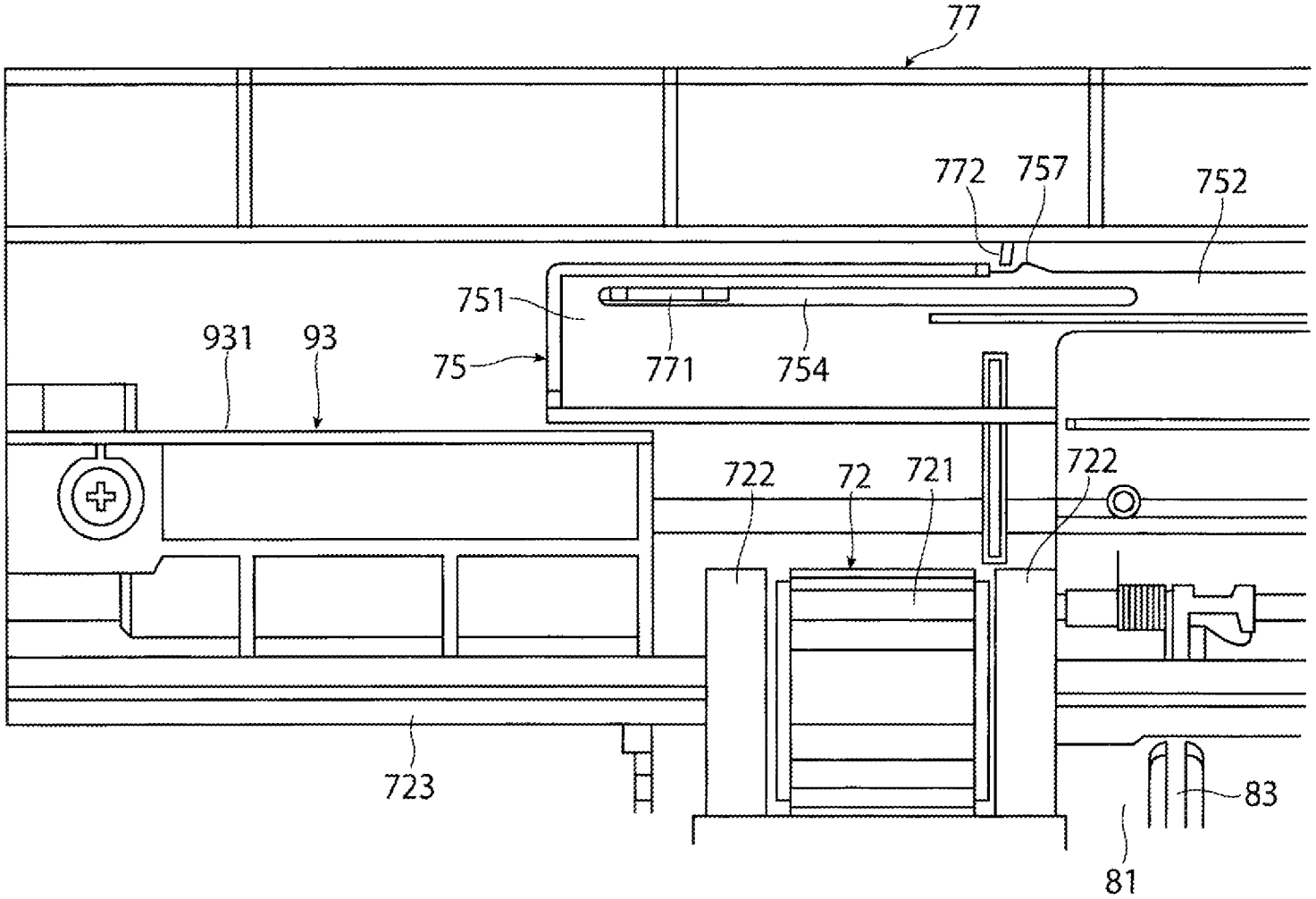
FIG. 6 is a front configuration view showing an inner surface of an inner cover.

In the opening and closing cover 75, a slit shaped guide groove 754 having a narrow width for attaching the opening and closing cover 75 to the inner cover 77 such that the opening and closing cover 75 is movable along the horizontal direction is formed from an upper end portion of the cover portion 751 to the guide rail portion 752. As shown in FIG. 6, a convex portion 771 protruding toward a back surface of the inner cover 77 is inserted into the guide groove 754 of the opening and closing cover 75. A grip portion 755 (see FIG. 5) that causes the opening and closing cover 75 to be opened and closed is provided along an upper-lower direction at one end portion of the cover portion 751 of the opening and closing cover 75 in a width direction.

As shown in FIG. 5, in the guide rail portion 752 of the opening and closing cover 75, a recess 756 for regulating a movement region of the opening and closing cover 75 at an upper end edge of the guide rail portion 752 is formed one step lower than the cover portion 751. At one end portion of the recess 756 of the guide rail portion 752 along a longitudinal direction of the recess 756, a stopper portion 757 configured to hold the opening and closing cover 75 at a closed position is provided in a small convex shape. As shown in FIG. 6, the stopper portion 757 of the guide rail portion 752 moves over a protrusion 772 protruding to a back surface of the inner cover 74, thereby holding the opening and closing cover 75 at the closed position. The stopper portion 757 of the guide rail portion 752 and the protrusion 772 of the inner cover 74 constitute a latch mechanism.

As shown in FIG. 1, the eaves portion 753 of the opening and closing cover 75 extends to a position corresponding to an end portion of the intermediate transfer belt 21 above the feed roller 72, and is set to a length extending to a vicinity of the developing device 14 of the yellow image forming device 10Y.

Figure 7:
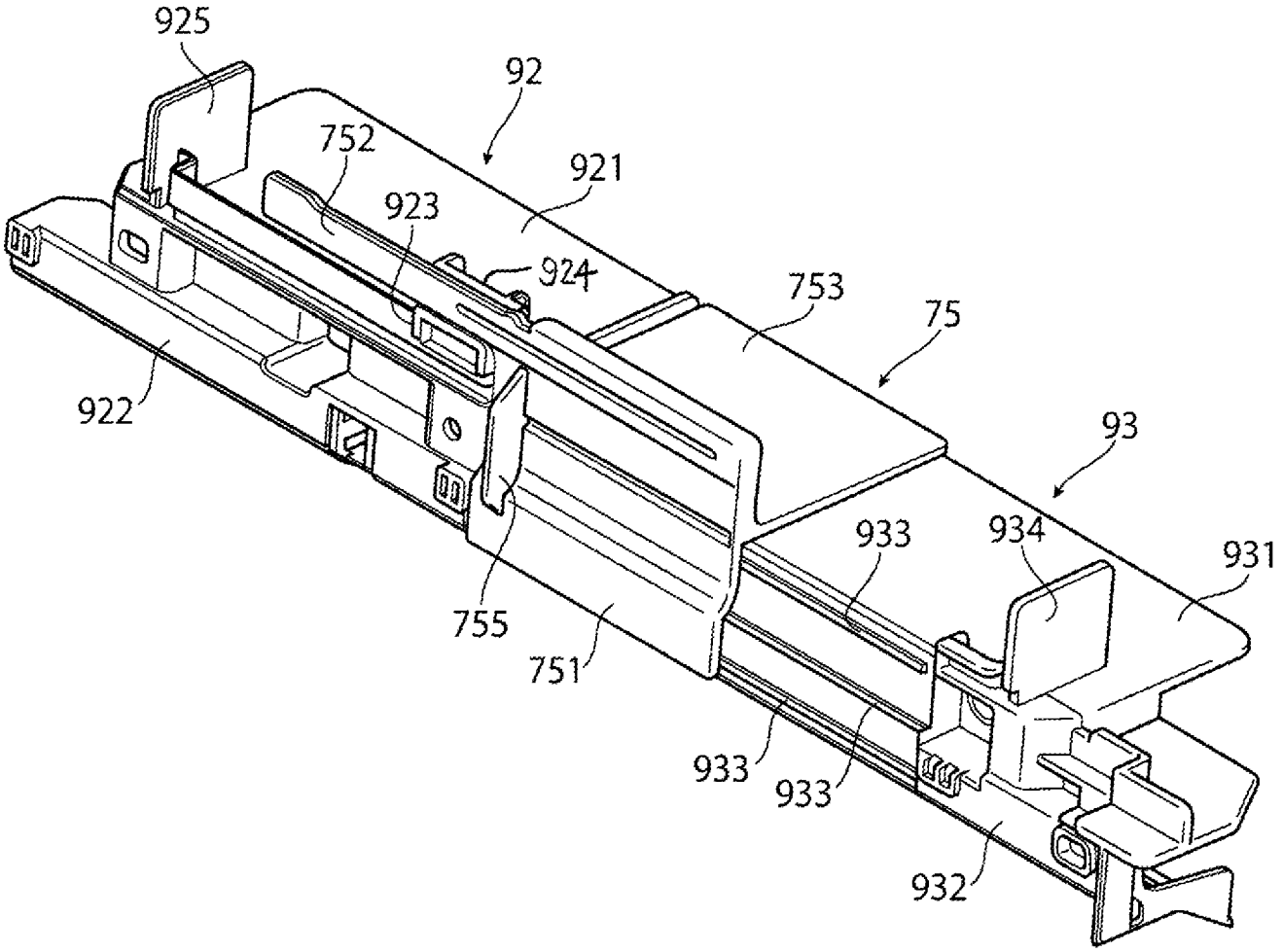
FIG. 7 is an external perspective view showing left and right frame members together with the opening and closing cover.

As shown in FIG. 7, left and right frame members 92, 93 are attached to the back surface of the inner cover 74 to guide the opening and closing cover 75 so as to be able to transfer the opening and closing cover 75 in the horizontal direction. The left frame member 92 includes a ceiling portion 921 having the same length as the eave portion 753 of the opening and closing cover 75, and an attachment portion 922 that is provided on a front surface side of the ceiling portion 921 and is configured to attach the frame member 92 to the back surface of the inner cover 74. The ceiling portion 921 of the left frame member 92 is provided with holders 923, 924 configured to hold the guide rail portion 752 of the opening and closing cover 75 in a state of sandwiching the guide rail portion 752 between the holders 923, 924. The ceiling portion 921 of the left frame member 92 is provided with a shielding plate 925 that stands upright and that is configured to shield a surrounding of a floating toner or the like at an end portion outside the ceiling portion 921. An actuator 83 of a sheet sensor is rotatably mounted on a back surface of the attachment portion 922 of the left frame member 92.

On the other hand, the left frame member 93 includes a ceiling portion 931 having the same length as the eave portion 753 of the opening and closing cover 75, and an attachment portion 932 that is provided on a front surface side of the ceiling portion 931 and is configured to attach the frame member 93 to the back surface of the inner cover 77. Plural ribs 933 configured to slidably guide the opening and closing cover 75 are provided along the horizontal direction at the attachment portion 932 of the right frame member 93. The ceiling portion 931 of the right frame member 93 is provided with a shielding plate 934 that stands upright and that is configured to shield a surrounding of a floating toner or the like at an end portion outside the ceiling portion 931. The ceiling portion 931 of the right frame member 93 faces the eaves portion 753 of the opening and closing cover 75 in a non-contact state with a minute gap between the ceiling portion 931 and the eaves portion 753.

<Operation of Manual Sheet Feeding Device>

In the image forming apparatus to which the manual sheet feeding device according to the first exemplary embodiment is applied, as described below, the feed roller 72 of the manual sheet feeding device 70 may be cleaned from the outside without using a configuration in which the manual sheet feeding tray 71 is pulled out from the apparatus body 1*a*.

In the image forming apparatus 1 according to the first exemplary embodiment, as shown in FIG. 2, when the user uses the manual sheet feeding device 70 to feed the recording sheet 5, the front cover 77 configured to cover the front surface of the apparatus body 1*a* is opened.

Then, when the front cover 77 is opened, the image forming apparatus 1 is in a state in which the manual sheet feeding tray 71 mounted on the inner side surface of the front cover 77 is inclined by the predetermined inclination angle θ' along with the opening operation of the front cover 77.

The user pulls out the extension tray 80 as necessary, and places the recording sheet 5 on the manual sheet feeding tray 71. When detecting that the front cover 77 is opened, the control device 100 identifies that the manual sheet feeding device 70 is used. When a print instruction is output by pressing a print start button or the like, the control device 100 starts driving rotation of the feed roller 72, the transport rollers 88 to 90, and the like, and feeds the recording sheets 5 placed on the manual sheet feeding tray 71 one by one.

Figure 9:
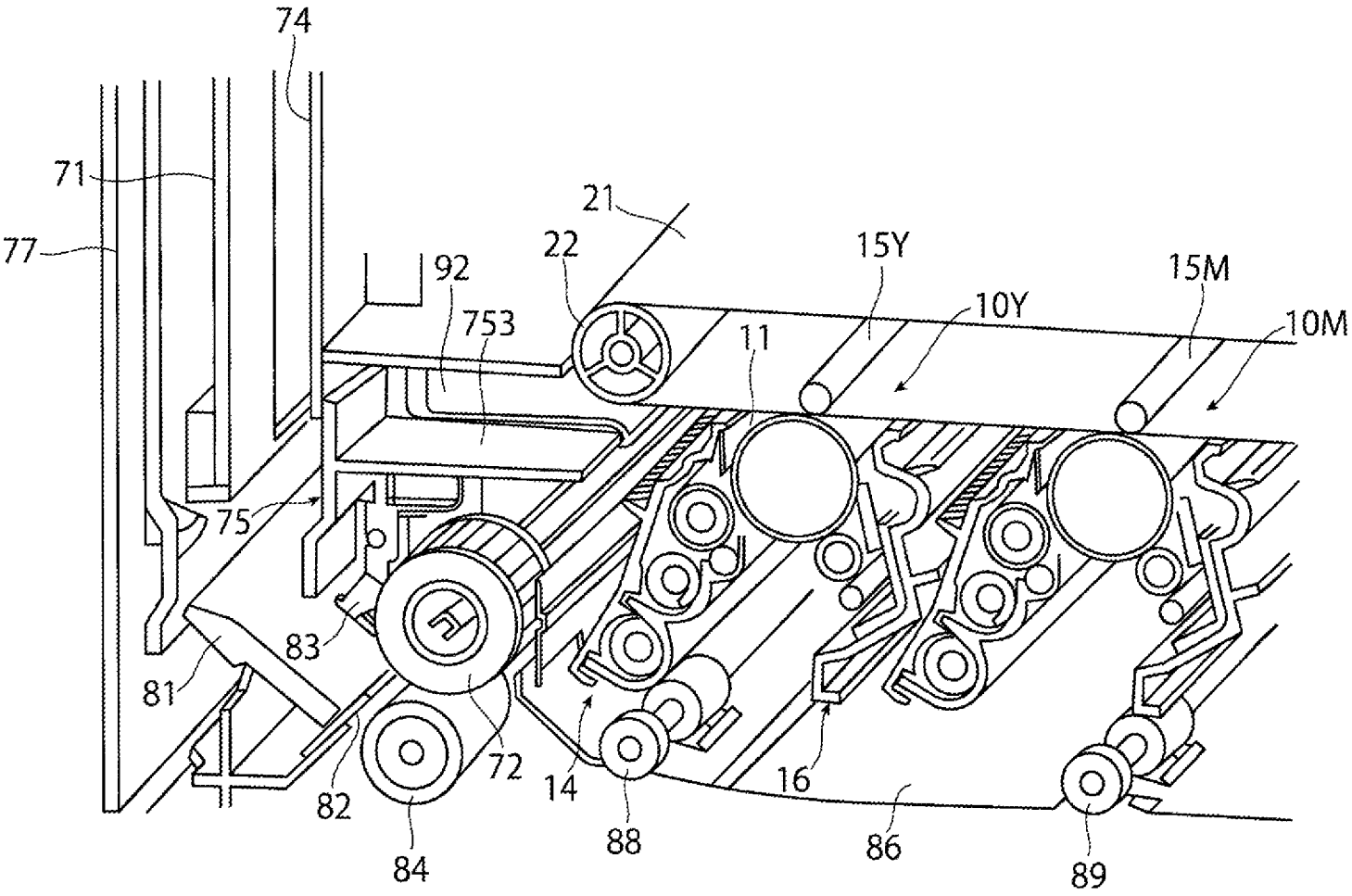
FIG. 9 is a cross-sectional perspective view showing the image forming apparatus to which the manual sheet feeding device according to the first exemplary embodiment of the present disclosure is applied.

As shown in FIG. 9, a cloud toner floating around the intermediate transfer belt 21, paper dust of the manually fed recording sheet 5, or the like adheres to the feed roller 72 of the manual sheet feeding device 70 along with the rotation of the intermediate transfer belt 21. When the cloud toner, the paper dust of the recording paper 5, or the like adheres to the feed roller 72 and accumulates, the feed roller 72 may slip when the recording sheet 5 placed on the manual sheet feeding tray 71 is fed, and a transport failure of the recording sheet 5 may occur.

In the first exemplary embodiment, as shown in FIG. 7, the opening and closing cover 75 is provided with the eaves portion 755, and the left and right frame members 92, 93 are provided with the ceiling portions 921, 931 equivalent to the eaves portion 753 of the opening and closing cover 75. However, the cloud toner may adhere to the feed roller 72 by wrapping around the eaves portion 755 of the opening and closing cover 75 and the ceiling portions 921, 931 of the left and right frame members 92, 93, and adhering the paper dust of the recording sheet 5 to the feed roller 72 is not prevented.

Therefore, in the manual sheet feeding device 70 according to the first exemplary embodiment, in order to eliminate the transport failure of the recording sheet 5 by the feed roller 72, when the image forming apparatus 1 is stopped, an operation of opening the opening and closing cover 75 is performed by the user or an engineer. The operation of opening the opening and closing cover 75 may be performed after a series of print operations performed by the image forming apparatus 1 has been completed, or may be performed when a transport failure of the recording sheet 5 by the feed roller 72 occurs.

Figure 8:
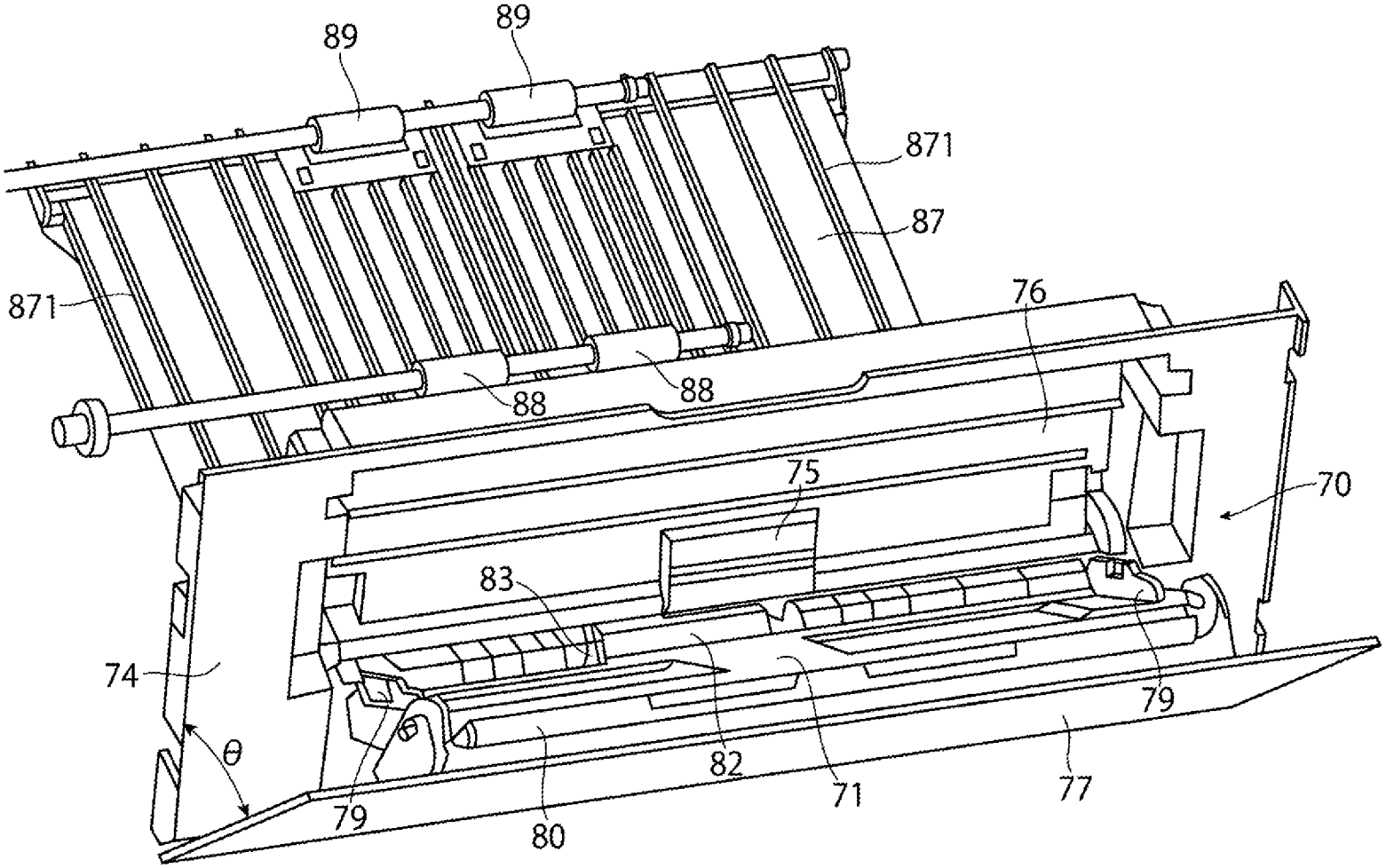
FIG. 8 is a perspective configuration view showing a state in which the opening and closing cover of the manual sheet feeding device according to the first exemplary embodiment of the present disclosure is closed.

When the front cover 77 is opened by the user, the inner cover 74 is exposed to the outside as shown in FIG. 8. At this time, the user opens the opening and closing cover 75 of the inner cover 74 by putting a hand of the user on the grip portion 755, so that the aperture 73 of the front cover 77 is opened, and the feed roller 72 that is not normally exposed to the outside is exposed to the outside.

Next, the user may remove the cloud toner, the paper dust of the recording sheet 5, or the like that adheres to and is accumulated on the surface of the feed roller 72 exposed to the outside by opening the opening and closing cover 75 by wiping the feed roller 72, a part on the front surface side of the feed roller 72 with a wet cloth or the like.

Thereafter, the user closes the opening and closing cover 75, so that the feed roller 72 is not exposed to the outside, and a good state on the external appearance of the apparatus and a state in which a driving unit cannot be touched are maintained.

In the image forming apparatus 1 to which the manual sheet feeding device 70 according to the first exemplary embodiment is applied, the feed roller 72 of the manual sheet feeding device 70 may be cleaned from the outside without using the configuration in which the manual sheet feeding tray 71 is pulled out from the apparatus body 1*a*.

In the above-described exemplary embodiment, a case has been described in which the present disclosure is applied to the full-color image forming apparatus serving as the image forming apparatus. However, the present disclosure is not limited thereto, and it is needless to say that the present disclosure may be similarly applied to a monochrome image forming apparatus.

Further, in the above-described exemplary embodiment, a case has been described in which the present disclosure is applied to the image forming apparatus configured to form an image by an electrophotographic process. However, the present disclosure is not limited thereto, and the present disclosure may be applied to an apparatus configured to form an image by an inkjet process or another process.

In the above-described exemplary embodiment, the reduction in size of the image forming apparatus has been described. However, the present disclosure is a technique particularly effective for a small image forming apparatus, and it is needless to say that a small image forming apparatus is not a condition when the present disclosure is applied.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit configured to form an image on a recording medium;

a manual sheet feeding device, wherein the manual sheet feeding device comprises:

a sheet feeding rotary body configured to separate and feed recording media placed on a manual sheet feeding unit one by one, wherein the manual sheet feeding device is configured to manually feed the recording medium toward the image forming unit;

a shielding unit configured to cover an outer side surface of the sheet feeding rotary body, the shielding unit having an aperture for exposing at least a part of the sheet feeding rotary body to an outside; and an opening and closing cover that is provided movably between a position at which the aperture of the shielding unit is exposed to an outside and a position at which the aperture of the shielding unit is closed by the opening and closing cover, wherein the opening and closing cover is openable and closable along a width direction of the recording media, and wherein the opening and closing cover comprises an eaves portion that is located above the sheet feeding rotary body and that is configured to prevent powder falling from above from adhering to the sheet feeding rotary body.

2. The image forming apparatus according to claim 1, wherein the opening and closing unit comprises a latch mechanism configured to hold the opening and closing cover in a position closing the aperture.

3. The image forming apparatus according to claim 2, wherein a transport path configured to transport the recording medium fed from the manual sheet feeding unit to the image forming unit is fixed to an apparatus body of the image forming apparatus.

4. The image forming apparatus according to claim 1, further comprising a front cover having an opening and closing angle set to be smaller than 90 degrees.

5. The image forming apparatus according to claim 4, wherein a transport path configured to transport the recording medium fed from the manual sheet feeding unit to the image forming unit is fixed to an apparatus body of the image forming apparatus.

6. The image forming apparatus according to claim 1, wherein the manual sheet feeding device is provided at an outer side surface of the shielding unit in a manner of being openable and closable.

7. The image forming apparatus according to claim 6, wherein a transport path configured to transport the recording medium fed from the manual sheet feeding unit to the image forming unit is fixed to an apparatus body of the image forming apparatus.

8. The image forming apparatus according to claim 1, further comprising a separating rotary body in contact with the sheet feeding rotary body, and wherein the sheet feeding rotary body intermittently rotates, and separates one by one the recording media whose front end comes into contact with a nip portion with the separating rotary body.

9. The image forming apparatus according to claim 1, wherein a transport path configured to transport the recording medium fed from the manual sheet feeding unit to the image forming unit is fixed to an apparatus body of the image forming apparatus.

10. An image forming apparatus comprising:

an image forming unit configured to form an image on a recording medium; and a manual sheet feeding device, wherein the comprises:

a sheet feeding rotary body configured to separate and feed recording media placed on a manual sheet feeding unit one by one wherein the manual sheet feeding unit is configured to manually feed the recording medium toward the image forming unit;

a shielding unit configured to cover an outer side surface of the sheet feeding rotary body, the shielding unit having an aperture for exposing at least a part of the sheet feeding rotary body to an outside; and an opening and closing cover that is provided movably between a position at which the aperture of the shielding unit is exposed to an outside and a position at which the aperture of the shielding unit is closed by the opening and closing cover, wherein the opening and closing cover is openable and closable along a width direction of the recording media, and the opening and closing cover comprises a latch mechanism configured to hold the opening and closing cover in a position closing the aperture, and wherein the opening and closing cover comprises an eaves portion that is located above the sheet feeding rotary body and that is configured to prevent powder falling from above from adhering to the sheet feeding rotary body.

11. The image forming apparatus according to claim 10, wherein the is provided at an outer side surface of the shielding unit in a manner of being openable and closable.

12. The image forming apparatus according to claim 11, wherein a transport path configured to transport the recording medium fed from the manual sheet feeding unit to the image forming unit is fixed to an apparatus body of the image forming apparatus.

13. The image forming apparatus according to claim 10, further comprising a front cover having an opening and closing angle set to be smaller than 90 degrees.

14. The image forming apparatus according to claim 13, wherein a transport path configured to transport the recording medium fed from the manual sheet feeding unit to the image forming unit is fixed to an apparatus body of the image forming apparatus.

15. The image forming apparatus according to claim 10, further comprising a separating rotary body in contact with the sheet feeding rotary body, and wherein the sheet feeding rotary body intermittently rotates, and separates one by one the recording media whose front end comes into contact with a nip portion with the separating rotary body.

16. The image forming apparatus according to claim 15, wherein a transport path configured to transport the recording medium fed from the manual sheet feeding unit to the image forming unit is fixed to an apparatus body of the image forming apparatus.

17. The image forming apparatus according to claim 10, wherein a transport path configured to transport the recording medium fed from the manual sheet feeding unit to the image forming unit is fixed to an apparatus body of the image forming apparatus.

* * * * *